United States Patent [19]

Jürgens

[11] Patent Number: 4,553,492

[45] Date of Patent: Nov. 19, 1985

[54] NEEDLE GUIDE FOR SEWING MACHINES

[75] Inventor: Erwin F. Jürgens, Hemmingen, Fed. Rep. of Germany

[73] Assignee: Union Special GmbH, Stuttgart, Fed. Rep. of Germany

[21] Appl. No.: 648,927

[22] Filed: Sep. 11, 1984

[30] Foreign Application Priority Data

Sep. 15, 1983 [DE] Fed. Rep. of Germany ..... 3333310

[51] Int. Cl.[4] ..... D05B 55/06

[52] U.S. Cl. ..... 112/227; 112/165; 112/197

[58] Field of Search ..... 112/227, 261, 98, 163, 112/165, 197

[56] References Cited

U.S. PATENT DOCUMENTS 1,157,892 10/1915 Moffatt et al. ..... 112/227
1,387,094 8/1921 Barron ..... 112/227
2,156,535 5/1939 Kucera ..... 112/227
3,872,810 3/1975 Johnson ..... 112/227

OTHER PUBLICATIONS

Union Special Stitch Formation Type 605 Instruction Manual, 1971, p. 4.

*Primary Examiner*—Werner H. Schroeder
*Assistant Examiner*—Andrew M. Falik
*Attorney, Agent, or Firm*—John A. Schaerli

[57] ABSTRACT

A reciprocally driven needle guide movable in timed relation with sewing machine needles above the work support of a sewing machine along a substantially horizontal path. The needle guide is provided with an extended guiding surface which is positioned adjacent the vertical path of the sewing machine needles to steady the needles while they are above the work supporting surface of the machine.

1 Claim, 3 Drawing Figures

NEEDLE GUIDE FOR SEWING MACHINES

FIELD OF THE INVENTION

This invention relates to sewing machines and, more particularly, to a guide for the sewing machine needles.

BACKGROUND OF THE INVENTION

Many of today's sewing machines use relatively thin or small diameter needles. As a result of the machine's high speed operation, these needles may oscillate when they are outside or about the workpiece. Unless controlled, needle oscillation can result in the needle striking the presser foot and/or the needle aperture provided in a throat plate whereby causing extensive damage to the parts effected.

The problem of needle oscillation has been addressed before. U.S. Pat. Nos. 1,433,872 and 1,444,633 issued to J. E. Chalman and J. R. Moffatt, respectively, illustrate how long this needle oscillation problem has existed. The needle guards patented in these disclosures, however, are concerned with controlling needle oscillation beneath the work supporting surface of the machine. These known needle guides can not and do not prevent vibration of the needle above the work supporting surface of the machine.

SUMMARY OF THE INVENTION

Because of the above, and in accordance with the present invention, there is provided a needle guide which serves to steady the needles while they are above the work supporting surface of the machine. To not restrict the stroke of the needles, the needle guide of the present invention is synchronously movable with the needles such that the guide is effectively withdrawn from adjacent the needles path once the needles move beneath the work supporting surface of the machine.

In the preferred embodiment, the needle guide is reciprocally driven along a path extending substantially perpendicular to and adjacent the vertical path of the needles. The needle guide includes an elongated arm or extension having a needle guiding face thereon; which extention moves behind and laterally across the needles so as to steady same. The needle guide is supported for reciprocal movement along a generally horizontal path which is disposed for the extent of its movement above the work supporting surface a distance generally corresponding to the height the needle tip moves above the work supporting surface when the needles are at their highest position. In the preferred embodiment, the needle guide is carried and supported by a cover thread spreader element which extends horizontally across the front of the needles. A recess is formed between the spreader element and the guiding surface or face of the needle guide. Through this recess, the needles reciprocate. The needle guide is adjustably secured to the spreader in a manner such that the size of the recess can be adjusted to compensate for various diameter needles.

With the above in mind, a primary object of this invention is the provision of a mechanism for steadying the needles while they are above the work supporting surface of the machine.

Another object of this invention is the provision of a needle guide which allows total needle reciprocation without interference by the needle guide.

Still another object of this invention is the provision of a needle guide mechanism which is responsive to the reciprocatory movement of the needles.

A further object of this invention is to provide means of the above character for supporting the needle guide and the cover thread spreader, if used, on a common support to simplify the struction of the machine.

Still a further object of this invention is to provide a needle guide which is shiftably supported above the work supporting surface of the machine for movement generally parallel with the work supporting surface and adjacent the needles path of travel.

BRIEF DESCRIPTION OF THE DRAWINGS

Having in mind the above objects and other attendent advantages that would be evident from an understanding of this disclosure, the invention comprises the devices, combination and arrangement of parts as illustrated in the presently preferred form of the invention which is hereinafter set forth in detail to enable those skilled in the art to readily understand the function, operation, construction and advantages of same when read in conjunction with the accompanying drawings in which.

DETAILED DESCRIPTION OF THE PRESENT INVENTION

Figure 1:
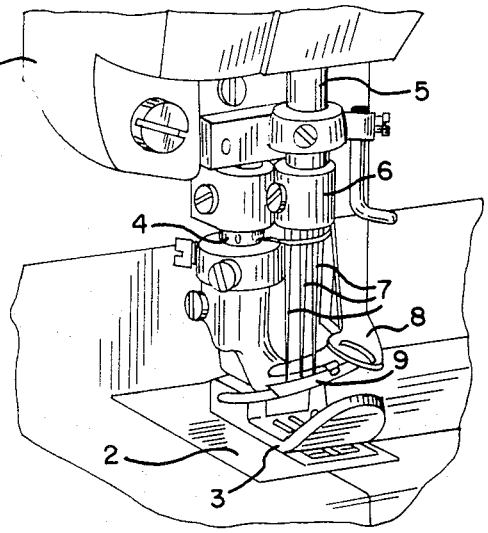
FIG. 1 is a perspective view of the present invention as mounted on a sewing machine head.
Figure 2:
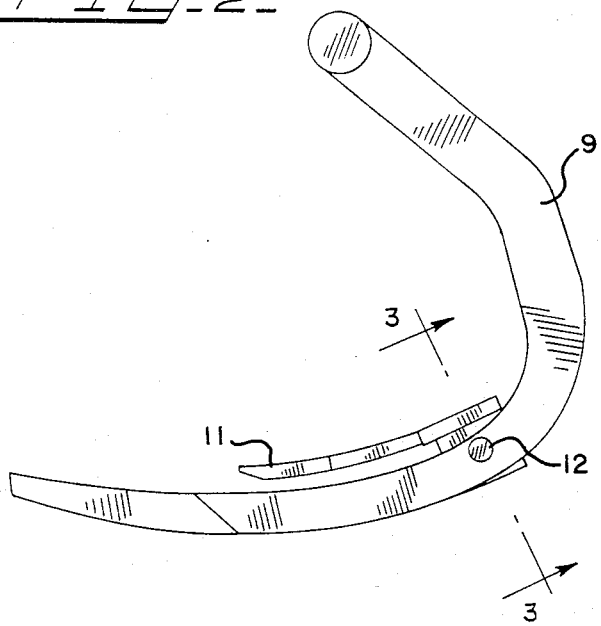
FIG. 2 is a top plan view of the present invention.
Figure 3:
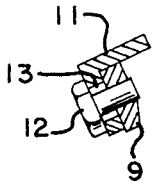
FIG. 3 is a cross sectional view taken along line 3—3 of FIG. 2.

Referring now in detail to the drawings, wherein like reference numerals indicate like parts throughout the several views, there is shown a sewing machine 1 of which only a portion of the usual overhanging sewing head is shown. Suffice it to say, the machine 1 is provided with a work support means 2 and presser foot mechanism 3 which combines with a feed mechanism for advancing a workpiece over the work supporting surface. A conventional spring urged presser bar 4, which is slidably mounted within the sewing head, serves to urge the presser foot against the work support of the machine. Also mounted for endwise reciprocal motion in the sewing head is a needle bar 5 having a needle mounting head 6 secured at its free end. The needle mounting head 6 serves as a support from which a series of laterally spaced thread carrying needles 7 depend. In the preferred embodiment, the needles are arranged to reciprocate in a common vertical plan or path. The free end or tip of the needle means reciprocate from a high position, located above the sewing machine work support, to a low position beneath the sewing machine work support whereat the needles combine with complimentary devices (not shown) in concatenating the thread into a stitch.

To steady the needles while they are above the sewing machine work support 2, a needle guide means 11 is provided. As is apparent from FIG. 1, the needle guide means 11 is disposed above the work support plate and includes an arm or member having a needle guiding surface which transversely spans the entire width or lateral spacing of the needles 7. The needle guide means 11 is reciprocally driven in timed relation with the needles and moves in a consistent path extending totally above the work supporting surface along a generally horizontal plan or path extending substantially perpendicular to the vertical path of the needles. The horizontal path of the needle guide means is preferably disposed above the work supporting surface a distance generally corresponding to the height the free end of the needles' measure above the work supporting surface when the needle is disposed in its high or up position. The path of the guiding means needle guiding face extends adjacent one side of the reciprocal path of the needles.

The guide means 11 is supported on a reciprocally driven member 9. In the exemplary embodiment, member 9 is a spreader element driven in timed relation with the needles reciprocatory motion. A sewing machine such as a class 57800E, equipped with a spreader element for a cover stitch usually includes a thread guide bracket 8 having a eye through which the cover thread extends. The spreader element 9 also includes a horizontally elongated arm or extension spanning the lateral spacing of the needles and which is adapted to move on the opposite side of the needle's vertical path whereby forming a recess through which the needles are guided while above the work supporting surface of the machine. The needle guide means 11 is provided with a slotted and outwardly extending leg which allows securement of the guide means 11 to the spreader element 9 by means of a fastener 12. An elongated slot 13 in the leg of the needle guide provides for adjustment of the needle guiding surface relative to the needles to compensate for different diameter needles.

In operation, the needle guide means 11 is reciprocally driven in timed relation with the vertical movement of the needles along a path extending above the work supporting surface of the machine. The recess formed between the driving member and the needle guiding surface of the needle guide serves as a needle passageway and prevents the needle from deflecting beyond certain operator controlled limits whereby enhancing the effectiveness of the machine.

Thus there has been provided a Needle Guide For Sewing Machines which fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Having thus adequately described by invention, what I claim is:

1. In combination with a sewing machine having a work supporting surface, a series of needles arranged to reciprocate in a generally vertical path, a spreader movable horizontally above the work supporting surface on one side of the needles vertical path and in timed relation with the needles reciprocatory movement, and a needle guide comprising:

operative means arranged above said work supporting surface and carried by said spreader means, said operative means having an extension arranged on the opposite side of the needles path whereby forming a recess through which the needles are guided while above the work supporting surface of the machine.

* * * * *